United States Patent [19]

Reuschenbach et al.

[11] Patent Number: 4,526,088

[45] Date of Patent: Jul. 2, 1985

[54] FLUID-OPERATED ACTUATING DEVICE

[75] Inventors: Hermann Reuschenbach, Rossbach;; Egon Sentinger, Koblenz, both of Fed. Rep. of Germany

[73] Assignee: Stabilus GmbH, Koblenz-Neuendorf, Fed. Rep. of Germany

[21] Appl. No.: 444,828

[22] Filed: Nov. 26, 1982

Related U.S. Application Data

[62] Division of Ser. No. 256,936, Apr. 23, 1981, abandoned.

[30] Foreign Application Priority Data

May 7, 1980 [DE] Fed. Rep. of Germany ..... 3017403

[51] Int. Cl.[3] ..... F15B 15/22

[52] U.S. Cl. ..... 92/12; 92/8; 92/143; 188/299; 188/300; 188/317

[58] Field of Search ..... 92/8, 9, 12, 143; 188/299, 300, 319; 188/317

[56] References Cited

U.S. PATENT DOCUMENTS

| | | | |
|---|---|---|---|
| 2,081,921 | 6/1937 | Gartin | 92/9 |
| 2,428,640 | 10/1947 | Smith | 92/9 |
| 3,315,768 | 4/1967 | Stuhler | 92/9 |
| 3,363,518 | 1/1968 | Boissevain | 92/12 |
| 3,447,645 | 6/1969 | Dörer | 188/269 |
| 3,559,776 | 2/1971 | Schultze | 188/300 |
| 3,659,684 | 5/1972 | Porter | 188/300 |
| 4,036,335 | 7/1977 | Thompson | 188/319 |
| 4,113,220 | 9/1978 | Godwin | 188/300 |
| 4,245,826 | 1/1981 | Winges | 188/300 |

FOREIGN PATENT DOCUMENTS

| | | | |
|---|---|---|---|
| 652901 | 11/1962 | Canada | 188/319 |
| 2607157 | 8/1977 | Fed. Rep. of Germany | 92/12 |
| 548272 | 9/1956 | Italy | 92/9 |

*Primary Examiner*—Abraham Hershkovitz
*Attorney, Agent, or Firm*—Brumbaugh, Graves, Donohue & Raymond

[57] ABSTRACT

A fluid-operated actuating device of the type including an actuating cylinder member, an axially movable actuating piston rod member, and actuating fluid connection means for introducing actuating fluid to and removing actuating fluid from the actuating cylinder member so as to adjust the relative axial position of the actuating cylinder and piston members and including structure for damping the movement of the piston rod member with respect to the cylinder member.

20 Claims, 7 Drawing Figures

FLUID-OPERATED ACTUATING DEVICE

This is a division of application Ser. No. 256,936, filed Apr. 23, 1981, now abandoned.

BACKGROUND

1. Field of the Invention

This invention relates to fluid-operated actuating devices of the type including an actuating cylinder member, an axially movable actuating piston rod member, and actuating fluid connection means for introducing actuating fluid to and removing actuating fluid from the actuating cylinder member so as to adjust the relative axial position of the actuating cylinder and piston members, and pertains in particular to new and improved structure for damping the movement of the piston rod member with respect to the cylinder member.

2. The Prior Art

It is known from U.S. Pat. No. 2,624,318 to provide a damping cylinder member and a damping piston rod member, one of said damping members being fastened to one of said actuating members and the other of said damping members being fastened to the other of said actuating members. The damping piston rod member in this known construction is fastened to a damping piston unit axially movable within said damping cylinder member, and flow passage means are provided for connecting two damping chambers defined within said damping cylinder by said damping piston unit. Damping valve means are associated to said flow passage means for varying the flow cross-section of said flow passage means. For operating said damping valve meansfrom a location outside said damping cylinder member said damping piston rod member is provided with an axially extending bore. Rod means extend through said bore from a handle provided outside said damping cylinder member to said damping valve means. The rod means are rotatable by said handle and transmit rotation to said damping valve means, said damping valve means being designed as rotary valve means.

This known device does not allow a precise and highly sensitive adjustment of the flow cross-section of said flow passage means so that it is not possible to adjust the flow cross-section of said flow passage means as precisely as desired.

SUMMARY

Accordingly, it is an object of the present invention to provide a fluid-operated actuating device in which a desired damping of the movement of the actuating piston rod member with respect to the actuating cylinder member can be precisely adjusted. A further object is to provide a structure which is both simple in design and reliable in operation.

This and aother objects of the invention are attained by the provision in a fluid-operated actuating device having an actuating cylinder member, an axially movable actuating piston rod member, and actuating fluid connection means for introducing actuating fluid to and removing actuating fluid from the actuating cylinder member of a damping means. These damping means comprise a damping cylinder member having an axis and two ends and defining a damping cavity therewithin; they further comprise a damping piston unit axially movable within said damping cavity in sealing engagement with the interior surface of said damping cylinder member and defining two damping chambers within said damping cavity; they further comprise a damping piston rod member connected to said damping piston unit for axial movement with said damping piston unit, said damping piston rod member extending in sealing relation through at least one end of said damping cylinder member; they further comprise a self-contained damping fluid sealed within said damping cavity; they further comprise flow passage means connecting said two damping chambers and extending through said damping piston unit; they further comprise damping valve means associated with said flow passage means for varying the flow cross-section of said flow passage means; they further comprise valve operating means associated with said damping valve means for controlling said damping valve means from outside said damping cylinder member, said valve operating means comprising rod means passing through an axial bore in said damping piston rod member, said rod means adjacent their end remote from said damping valve means being operatively connected to adjusting means provided at said at least one end of said damping piston rod member. One of said damping members, i.e., said damping cylinder member or said damping piston rod member, is connected to one of said actuating members, i.e., said actuating cylinder member or said actuating piston rod member, and the other of said damping members is connected to the other of said actuating members.

Moreover, the flow cross-section defined by said damping valve means is variable by axial movement of said rod means, said rod means are provided with substantially axially directed engagement face adjacent said remote end thereof; and biasing means are provided for urging said engagement face towards engagement with a continuously adjustable counterengagement face of said adjusting means.

The counterengagement face may be defined by an axially directed terminal face of a counterengagement member, said counterengagement member being adjustable with respect to said damping piston rod member in a direction parallel to the axis of said damping cylinder member.

Assuming such a basic design, said counterengagement face may be defined by a substantially axially directed terminal face of a set screw, said set screw having an axis substantially parallel to the axis of said damping cylinder member and being adjustable along its axis with respect to said damping piston rod member. The set screw may be provided with a fine thread so that a very sensitive and precise adjustment of the counterengagement member is possible.

According to another embodiment, the counterengagement face is defined by a cam face of a counterengagement member, said counterengagement member being adjustable along a direction substantially transverse with respect to the axis of said damping cylinder member, said cam face being inclined with respect to said transverse axis. By a small inclination of said cam face a precise and sensitive adjustment can be achieved.

Assuming such a basic design, said counterengagement face may be defined by a substantially conical circumferential face of a set screw, said set screw having an axis substantially transverse with respect to the axis of the damping cylinder member and being adjustable with respect to said damping piston rod member along said transverse axis.

According to still another embodiment, the counterengagement face is defined by a counterengagement member with counterengagement member is movable with respect to said damping piston rod member, the range of movement of said counterengagement member being defined by at least one adjustable abutment member. In this embodiment, it is possible to precisely and sensitively define at least one damping condition and moreover to provide at least one further different damping condition.

BRIEF DESCRIPTION OF THE DRAWINGS

The invention will now be further described with reference to the illustrative embodiments thereof shown in the accompanying drawings in which.

DETAILED DESCRIPTION

Figure 1:
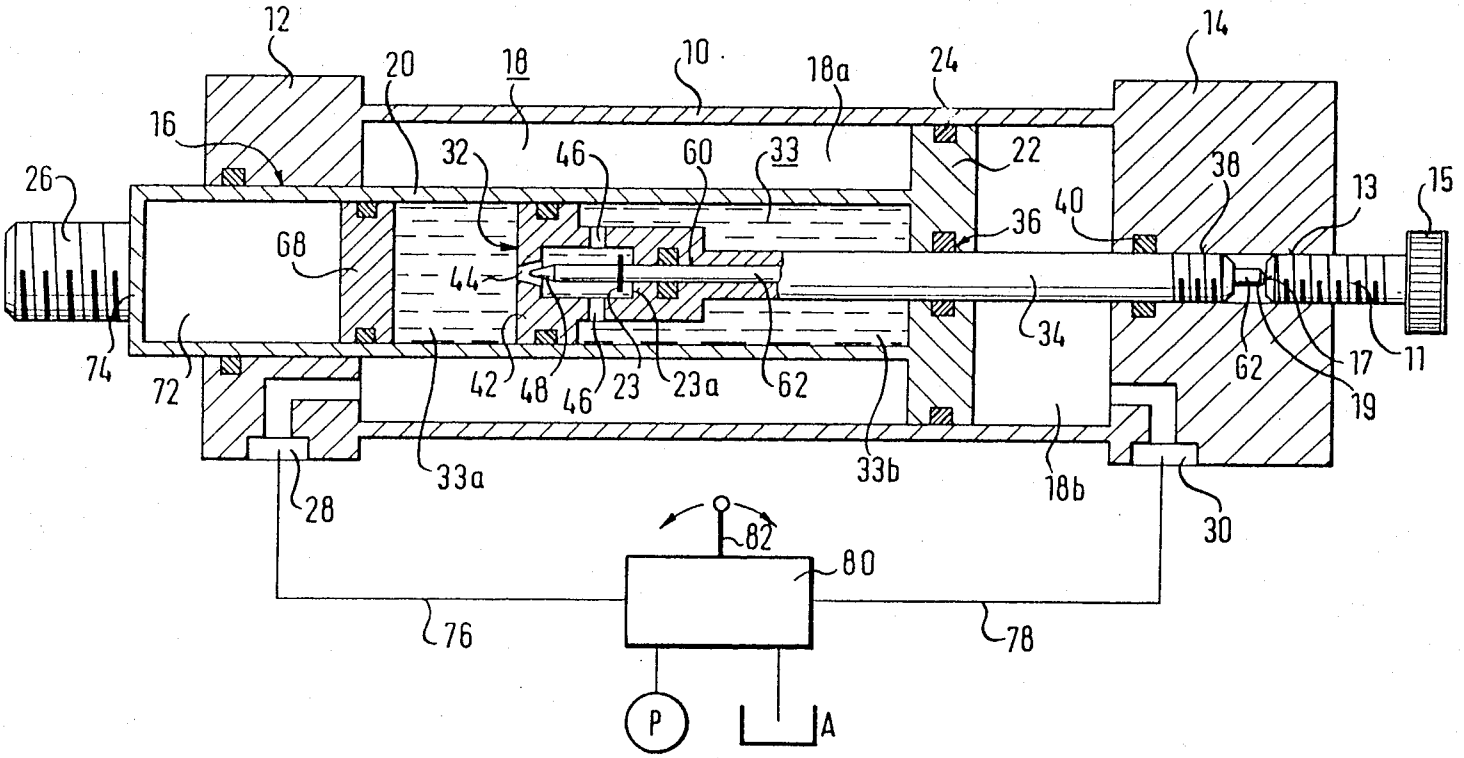
FIG. 1 is a longitudinal sectional view of a first embodiment of a fluid-operated actuating device constructed in accordance with the invention, showing a first type of adjusting means.

In the embodiment of FIG. 1, the actuating cylinder member, designated generally by the number 10, includes two end portions 12 and 14, the former 12 of which is provided with a guiding and sealing unit 16. An actuating cavity 18 is defined within the actuating cylinder member 10. An actuating piston rod member 20 extends through the guiding and sealing unit 16, inward and outward of the cavity 18, and carries at its axially inner end an actuating piston 22. The actuating piston 22 is provided with an annular sealing member 24 which is in sealing engagement with the inner cylindrical face of the actuating cylinder member 10, thereby defining within the cavity 18 two actuating chambers 18*a* and 18*b*. The actuating chamber 18*a* is connected to a fluid connection port 28, while the actuating chamber 18*b* is connected to a fluid connection port 30. At its axially outer end, the actuating piston rod member 20 is provided with a fastening extension 26 for connecting the actuating piston rod member 20 to one of two objects to be moved with respect to each other. It will be understood that the end portion 14 of the cylinder member 10 likewise is adapted for connection to the other of the two objects.

It will be appreciated that two actuating chambers 18*a* and 18*b* and the corresponding fluid connection ports 28 and 30 are desirable where dual (two-way) action of the fluid actuating device is intended. Where fluid activation of the device in only one direction is needed, however, as, for example, where the device is used to lift a weight, only the chamber 18*a* is necessary. In this case, the piston unit 22 could be dispensed with, and the fluid in chamber 18*a* could act directly against the inner end of the piston rod member 20.

In accordance with the invention, the actuating piston rod member 20 is preferably hollow and defines a damping cylinder member, which cylinder member in turn defines a damping cavity 33 therewith and includes a damping piston unit 32. The damping piston unit 32 is connected to the inner end of a damping piston rod member 34 that extends inward and outward of the damping cavity 33 through a guiding and sealing unit 36 provided in the actuating piston 22, which simultaneously serves as an end portion of the damping cavity 33. The outer end of the damping piston rod member 34 is threaded or otherwise fastened in a bore 38 of the end portion 14 of the actuating cylinder member 10. An annular sealing member 40 surrounds the bore 38 and engages the damping piston rod member 34 to seal the actuating chamber 18*b*.

As will be understood, the foregoing arrangement of the actuating piston rod member 20 and the damping piston rod member 34, wherein the member 20 passes through only the end portion 12 of the cylinder member 10 and, in addition, itself defines the damping cavity 33, and the piston rod member 34 which is connected to the other end 14 of the cylinder 10, provides a very compact construction of the overall actuating device.

The damping piston unit 32 suitably comprises a piston member 42 which is in sealing and sliding engagement with the inner cylindrical face of the actuating piston rod member 20 so as to divide the damping cavity 33 into two damping chambers 33*a* and 33*b*. The piston member 42 is provided with a central axial bore 44 of conical configuration that connects the damping chamber 33*a* by way of bores 46 to the damping chamber 33*b*. In the central bore 44 there is housed a conical damping valve member 48 cooperating with the bore 44 to define throttled flow passage means between the damping chambers 33*a* and 33*b*.

The damping piston rod 34 is formed with an axial bore 60 in which is housed a valve operating rod 62. The valve operating rod 62 is integral at its inner end with the conical damping valve member 48.

The damping chambers 33*a* and 33*b* are filled with a suitable damping fluid, preferably a liquid such as hydraulic oil. If a liquid is used, it is necessary to compensate for the variation in the volume of the damping cavity 33 that is occupied by the piston rod 34 during axial movement of the rod into and out of the damping cylinder 20. This may be done by providing an equalizing piston rod member on the left-hand end (as seen in FIG. 1) of the damping piston unit, so that the damping piston rod member in effect extends through both end walls of the damping cylinder member. In this case the volume of the damping piston rod member within the damping cavity remains constant regardless of the axial position of the rod within the damping cylinder. A further advantage is that an identic damping function is achieved in both directions of movement of the rod. For compactness and ease of mounting to the fluid-operated actuating device, however, the damping piston rod member preferably passes through only one end of the damping cylinder member (as shown in FIG. 1). In this instance, compressible volume compensating means are provided for compensating for the variation in rod volume within the damping cavity during axial movement of the damping piston rod member with respect to the damping cylinder member. One embodiment of compensating structure is depicted in FIG. 1, wherein the left-hand end of the damping chamber 33*a* is defined by a movable separating member 68 which is in sealing engagement with the inner cylindrical face of the actuating piston rod member 20 and which is backed by a volume of pressurized gas housed within a chamber 72 defined within the actuating piston rod member 20 between an end wall 74 thereof and the separating member 68. As will be understood, the volume of pressurized gas acts on the separating member 68 so that the liquid in damping chambers 33*a* and 33*b* is under pressure. Alternatively, the chamber 68 could accomodate a mechanical spring in lieu of or in addition to the pressurized gas.

With reference now again to FIG. 1, the fluid connection ports 28 and 30 are connected by lines 76 and 78 to an actuating control unit 80 which is in connection with a source P of pressurized air and with atmosphere A. The control unit 80 and source P may be of any suitable commercially available type. Although the actuating fluid preferably is a gas, conveniently air, it will be understood that a liquid may be used if desired. A gas is preferred, however, because it facilitates precise positioning of the actuating rod relative to the actuating cylinder. The actuating control unit 80 includes an actuating lever 82, that is movable from a central neutral position (shown in FIG. 1) to left-hand and right-hand actuating positions (as indicated by the arrows in FIG. 1). In the left-hand actuating position of the lever 82, the actuating chamber 18*a* is connected to the source P and the right-hand actuating chamber 18*b* is connected to atmosphere. Under these conditions, the air pressure contained in the actuating chamber 18*a* acts on the actuating piston 22 and seeks to drive it and the piston rod member 20 to the right (as viewed in FIG. 1). Such movement of the actuating piston rod member is damped because the flow of the liquid contained in the damping chamber 33*a* to the damping chamber 33*b* is throttled at 44. During this movement, the separating member 68 is urged towards the end wall 74 against the pressure of the gas in the chamber 72 due to the increase of the volume of the damping piston rod member 34 within the damping chamber 33.

When the control lever 82 of the actuating control unit 80 is moved to the right-hand positions, pressurized air from the source P is admitted through the fluid connection port 30 to the right-hand actuating chamber 18*b* and the left-hand actuating chamber 18*a* is connected via the actuating fluid connection port 28 and line 76 to atmosphere. Consequently, the pressurized air acting on the right-hand side of the actuating piston 22 pushes the actuating piston rod member 20 to the left (as viewed in FIG. 1). Such movement is also damped because the flow of the liquid from the damping chamber 33*b* to the damping chamber 33*a* is throttled at 44. During this movement, the volume of the damping piston rod member 34 within the damping cavity 33 decreases so that the separating member 68 is pushed away from the end wall 74 by the gas pressure in the chamber 72.

As can be seen from FIG. 1, a set screw 11 is provided in a threaded bore 13 of the end portion 14. The set screw 11 is provided with a knob 15 at its right-hand end and with a counterengagement face 17 at its left-hand end. The counterengagement face 17 is engaged by an engagement face 19 at the right-hand end of the valve operating rod 62. By turning the set screw 11, the position of the conical damping valve member 48 can be adjusted in axial direction with respect to the conical bore 44 so that the throttling cross-section of the flow passage means between the damping chambers 33*a* and 33*b* can be adjusted precisely to the desired damping action.

It is to be noted that the pressurized liquid contained in the damping cavity 33 acts onto the operating rod member 62 urging said operating rod member 62 to the right as seen in FIG. 1 into engagement with the set screw 11. An abutment disc 23 prevents the operating rod member 62 from being lost when the set screw 11 has been removed.

Figure 2:
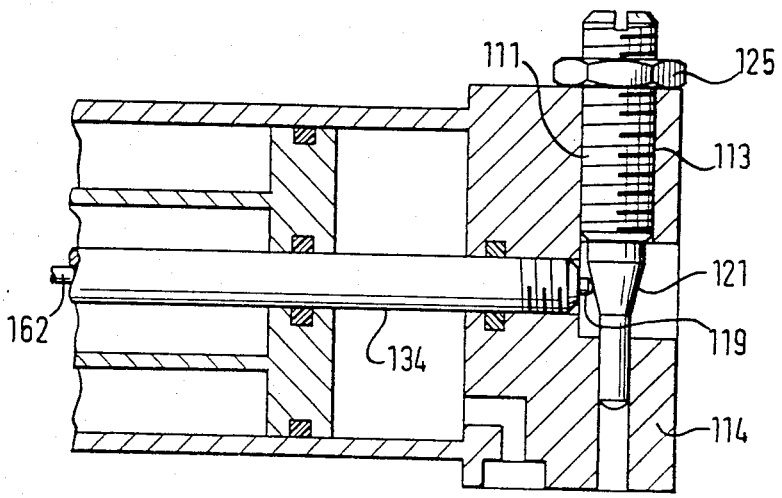
FIG. 2 is a similar partial view of another embodiment showing a second type of adjusting means.

FIG. 2 shows a modified embodiment. Analogous parts are designated by like reference numerals as used in FIG. 1, however increased by 100. In FIG. 2, the set screw 111 is arranged in transverse direction with respect to the axis of the damping piston rod member 134. The set screw is inserted into a threaded bore 113 of the end portion 114. A conical circumferential cam face 121 is provided in the middle section of the set screw 111. This conical cam face 121 acts as the counterengagement face for the engagement face 119 provided at the right-hand end of the valve operating rod member 162. The set screw 111 is secured by a securing unit 125.

Figure 3:
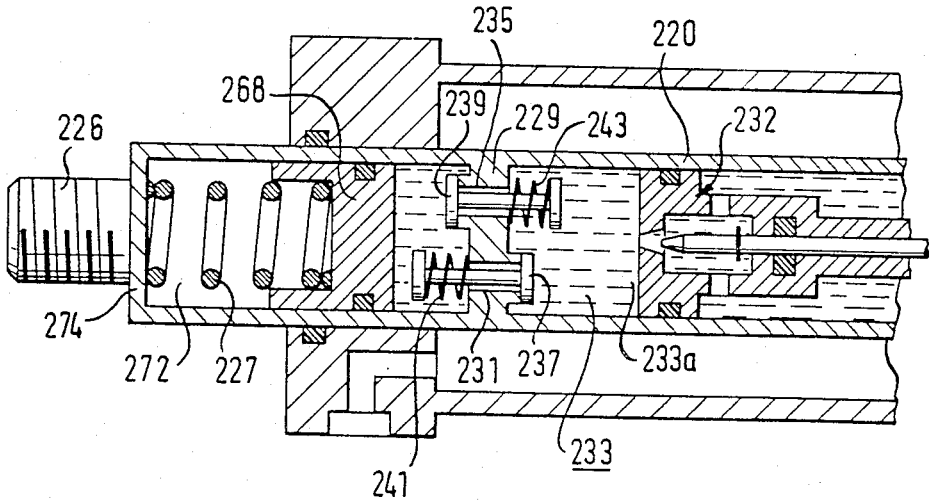
FIG. 3 is a similar partial view of another embodiment of a fluid-operated actuating device, showing a different type of a damping cylinder.

In the embodiment of FIG. 3, analogous parts are designated by like reference numerals as in FIG. 1, however increased by 200. In the embodiment of FIG. 3, the pressurized gas volume in the chamber 272 has been replaced by a mechanical compression spring 227.

Moreover, in the embodiment of FIG. 3 there is provided a dividing wall 229 within the damping cavity 233. This dividing wall 229 comprises two passages 231 and 235. Throttling valve members 237 and 239 are associated to the passages 231 and 235 respectively. The throttling valve members 237, 239 are biased into closed condition by valve springs 241 and 243 respectively. The passage 235 is opened when the actuating piston rod member 220 moves to the right and the passage 231 is opened when the actuating piston rod member 220 moves to the left. The valve spring 243 is relatively strong as compared with the valve spring 241, so that on movement of the actuating piston rod member 220 to the right the pressure of the liquid contained in the damping chamber 233*a* is substantially independent of the stiffness of the mechanical spring 227. As a consequence thereof, the damping effect onto the actuating piston rod member 220 is substantially the same when moving to the left and when moving to the right as seen in FIG. 3.

Figure 4:
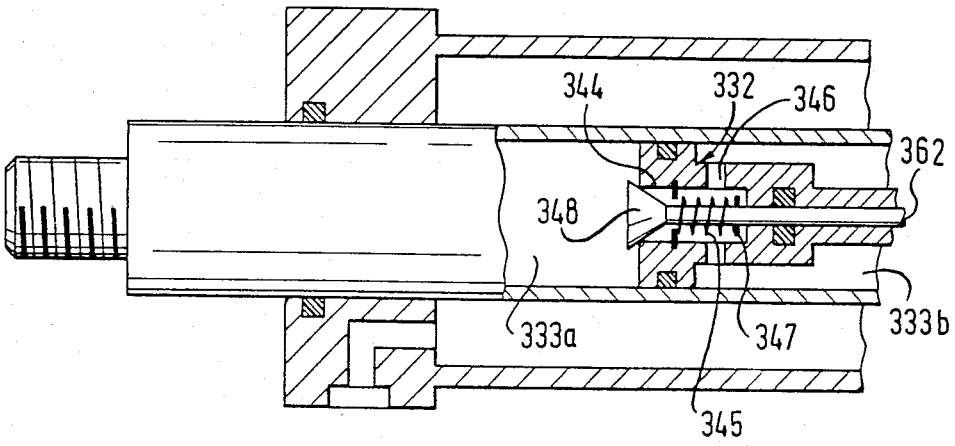
FIG. 4 is a similar partial view of another embodiment, showing a different type of damping valve means.

In the embodiment of FIG. 4, analogous parts are designated by like reference numerals as in FIG. 1, however increased by 300.

In this embodiment, the damping valve member 348 is arranged in such a way with respect to the central bore 344 that the flow cross-section of the passage means interconnecting the damping chambers 333*a* and 333*b* is at a minimum when the operating rod member 362 is in its most right position. In addition to the pressure of the liquid contained in the damping chamber 333*a* a helical compression spring 345 acts onto a spring support disc 347 fastened to the operating rod member 362. This helical compression spring 345 is of particular importance when the superatmospheric pressure within the damping chamber 333*a* is relatively small.

In the embodiment as shown in FIG. 4, the damping valve member 348 completely closes the fluid connection between the damping chambers 333*a* and 333*b*. One can easily understand however that the damping valve member 348 can be continuously adjusted into positions defining various flow cross-sections, e.g. by the set screw 11 of FIG. 1 or by the set screw 111 of FIG. 2.

Figure 5:
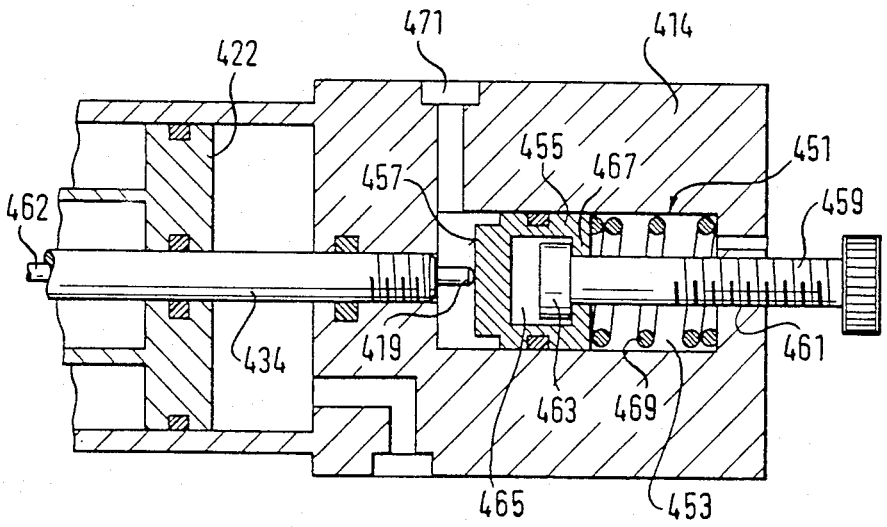
FIG. 5 is a similar partial view of another embodiment, showing a third type of adjusting means.

In the embodiment as shown in FIG. 5 analogous parts are designated by like reference numerals as in FIG. 1, however increased by 400.

In the embodiment of FIG. 5 there is provided a fluidic drive unit 451 in the end portion 414. This fluidic drive unit comprises a drive cylinder 453 and a drive piston 455 in said drive cylinder. The drive piston 455 is provided with a counterengagement face 457 which is in engagement with the engagement face 419 and the right-hand end of the operating rod member 462. The position of the drive piston member 455 as shown in FIG. 5 is defined by an adjustable abutment screw 459. This abutment screw 459 is threaded into a bore 461 of the end portion 414. An abutment head 463 of the abutment screw 459 is housed within a recess 465 of the drive piston member 455. This abutment head 463 is in engagement with an engagement shoulder 467 surrounding the aperture through which the abutment screw 459 enters into the recess 465.

A helical compression spring 469 biases the drive piston member 455 into engagement with the abutment head 463. By turning the abutment screw 459 the position of the operating rod member 462 can be continuously adjusted. In addition, the drive cylinder 453 is provided with a drive fluid port 471. By admitting a drive fluid to the drive cylinder 453 the drive piston member 455 can be pushed to the right so that the operating rod member 462 can take a position as shown e.g. in FIG. 4 or a position as shown in FIG. 1 in which the abutment disc 23 engages the face 23*a*.

So, it is possible by admitting or non-admitting drive fluid to the cylinder 453 to bring the operating rod member 462 either in a predetermined position or in a variety of continuously adjustable positions.

The cylinder 453 is connected to the atmosphere on the right-hand side of the drive piston member 455.

Figure 6:
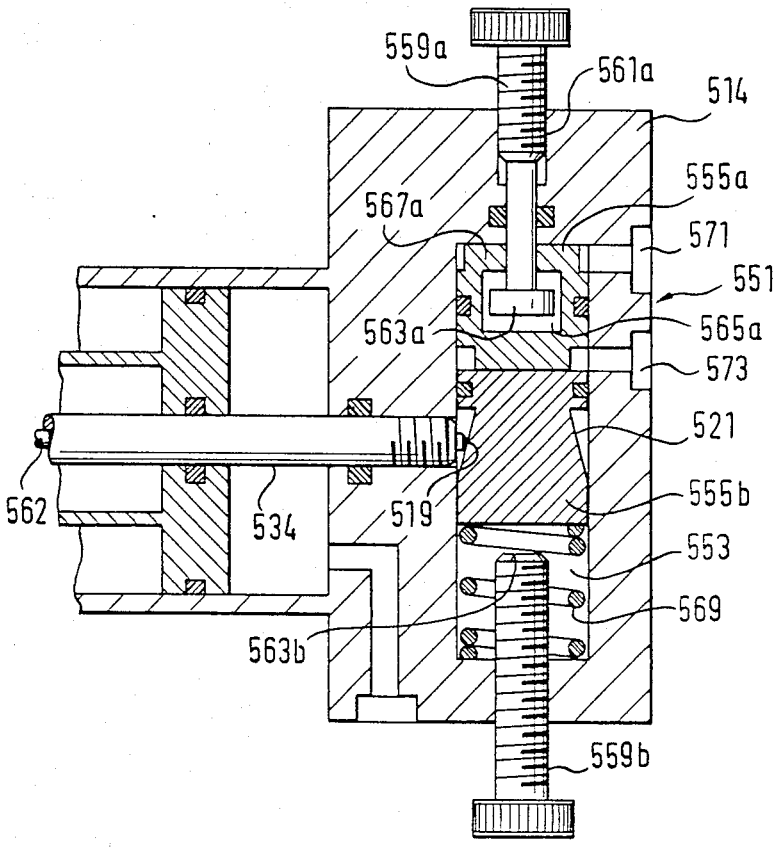
FIG. 6 is a similar view of another embodiment, showing a further type of adjusting means.

In the embodiment of FIG. 6 analogous parts are designated by like reference numerals as in the preceding Figures, but having as first number a 5.

It is to be noted that in FIG. 6 there are a first drive piston member 555*a* and a second drive piston member 555*b* within the drive cylinder 553. The helical compression spring 569 urges the second drive piston member 555*b* against the first drive piston member 555*a* and the first drive piston member 555*a* against the upper end of the drive cylinder. The conical counterengagement face 521 is provided on the second drive piston member 555*b*. This conical counterengagement face 521 is in engagement with the engagement face 519 of the operating rod member 562 under the action of the pressurized fluid in the damping chamber or of the helical compression spring 345 of FIG. 4.

When drive fluid is admitted through the drive fluid port 573 the second drive piston member 555*b* is moved downward against the action of the compression spring 569 until it abuts against the abutment face 563*b* of the second abutment screw 559*b*. So, a further position of the operating rod member 562 can be obtained, which further position is continuously adjustable by turning the abutment screw 559*b*. At the same time, the piston rod member 555*a* is maintained in its position as shown in FIG. 6 by the drive fluid admitted through the drive fluid port 573 as long as no drive fluid is admitted through the drive fluid port 571.

When drive fluid is admitted through the drive fluid port 571 and the drive fluid port 573 is connected to the atmosphere the first drive piston member 555*a* is moved downward until the shoulder 567*a* abuts against the abutment head 563*a* and the second drive piston member 555*b* is entrained by the first drive piston member 555*a*. So, the operating rod member 562 can be brought in a further position which can be continuously varied by screwing the abutment screw 559*a* in the threaded bore 561*a*.

Figure 7:
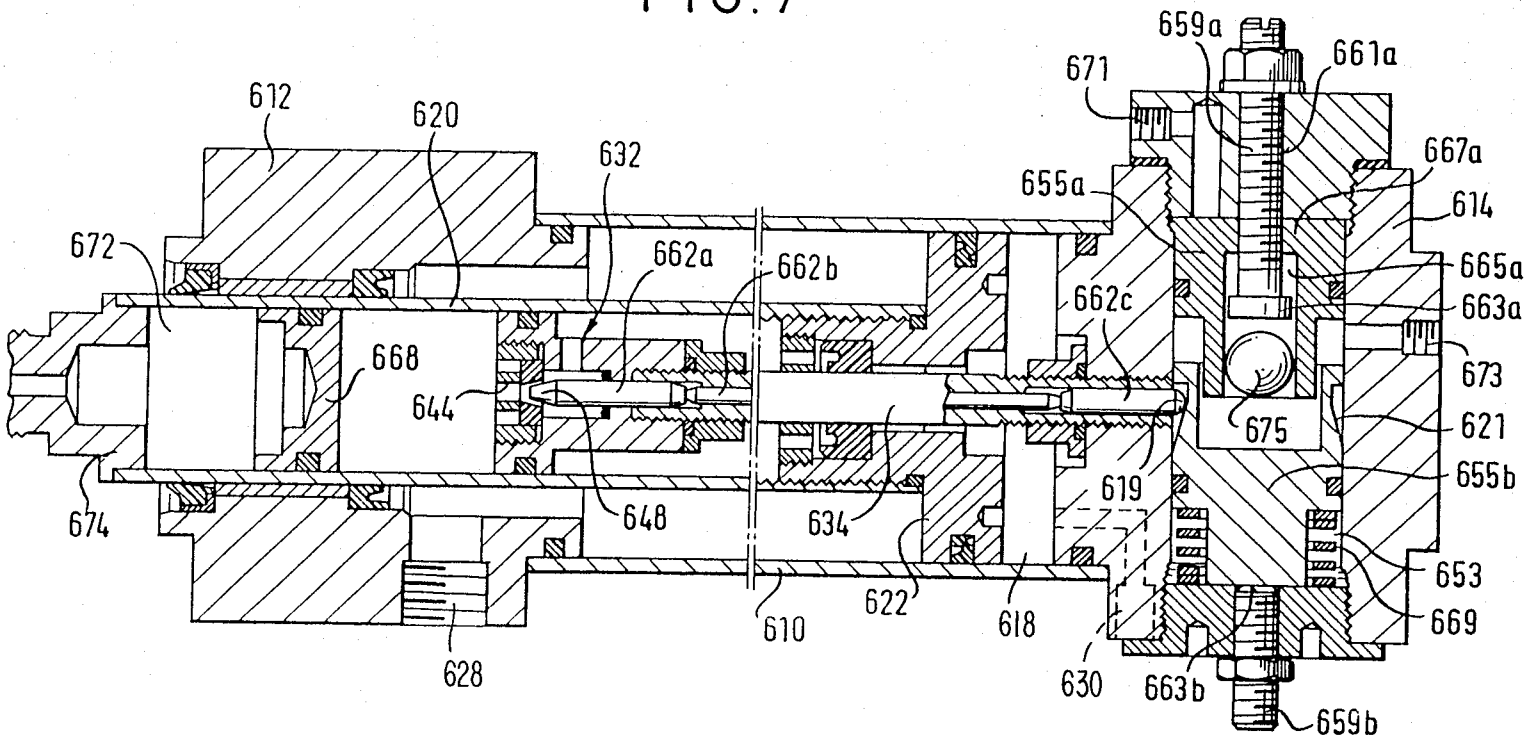
FIG. 7 is a similar longitudinal sectional view of an embodiment showing the type of adjusting means as shown in FIG. 6.

FIG. 7 shows in more detail an embodiment corresponding in its left-hand part to the embodiment of FIG. 1 and in its right-hand part to the embodiment of FIG. 6. Analogous parts are designated by like reference numerals as in FIGS. 1 and 6, however increased by 600 and 100 respectively.

In FIG. 7, the first and second drive piston members 655*a* and 655*b* are in the position which results from admitting drive fluid through the drive fluid port 673 and connecting the drive fluid port 671 to the atmosphere. Moreover, one can see from FIG. 7 that the recess 665*a* is closed by a spherical plug member 675 so that no drive fluid can escape through the threaded bore 661*a* along the abutment screw 659*a*. When both drive fluid ports 671 and 673 are connected to the atmosphere the second drive piston member 655*b* is moved upwards by the compression spring 669 so that the bore 644 can be closed by the damping valve member 648. The maximum flow cross-section at 644 is obtained in the position as shown in FIG. 7 when the abutment screw 659*b* is fully retracted from the cylinder 653. Other cross-sectional areas can be obtained by adjusting the abutment screws 659*a*, 659*b*.

With the embodiments shown in FIGS. 6 and 7 it is possible to obtain two positions of different but continuously variable flow cross-sections at 644 and moreover to obtain a condition in which the bore 644 is fully closed. When the bore 644 is fully closed by connecting both ports 671 and 673 to the atmosphere the damping unit may act as a blocking unit as described in the copending older U.S. application Ser. No. 147,747 (Stabilus Case 718). It is to be noted that the operating rod member 662 of FIG. 7 consists of a series of rod sections 662*a*, 662*b*, 662*c*.

As can further be seen from FIG. 7 the end portions 612 and 614 are fitted into the ends of the actuating cylinder member 610 and fixed e.g. by tension rods. Also, it will be understood that, as in the previously described embodiments, the actuating cavity 618 is connected to fluid connection ports 628 and 630 for carrying the activating fluid to and from the cavity 618.

It is to be noted that the drive fluid may be derived from the fluid source which also delivers fluid to the fluid ports of the actuating cavity 18. The circuitry means for such an arrangement are easily available on the market.

It is further to be noted that the embodiments as shown in FIGS. 2, 3, 4, 5 and 6 can be combined in any way and can be combined also with parts of the embodiments as shown in FIGS. 1 and 7.

Although the invention has been described with reference to specific embodiments thereof, many modifications and variations of such embodiments may be made by those skilled in the art without departing from the inventive concepts disclosed. Accordingly, all such modifications and variations are intended to be included within the spirit and scope of the appended claims.

It is to be noted that the adjusting means can be adapted to the respective actuating device and to the respective field of use. It is easy to replace in an actuating device predetermined adjusting means by other ones.

It is further to be noted that, assuming a given pressure of the pressure source P, the actuating velocity of the actuating device can be varied by varying the flow cross-section of the flow passage means bridging the damping chambers.

In the embodiments of FIGS. 6 and 7 different modes of operation are possible:

(a) In a first mode of operation, the flow passage 644 is closed in the position of FIG. 6. In the position of FIG. 7 an adjustable maximum flow cross-section is obtained at 644 (fast speed of the actuating device). When fluid is admitted at 671 and port 673 is connected to atmosphere low speed actuation of the actuating device occurs. Both fast speed and low speed operations can be adjusted by the abutment screws 659*b* and 659*a* respectively.

(b) It is also possible to provide two adjustable actuating speeds of the actuating device and one fast speed.

(c) Finally, it is possible to provide 3 adjustable actuating speeds.

The reference numerals in the claims are only for an easy understanding and are not to be understood as being restrictive.

What is claimed is:

1. In a fluid-operating actuating device comprising an actuating cylinder member having an axis and two ends and defining therewith an actuating cavity; an axially movable actuating piston rod member extending in sealing relation through at least one of said two ends of the actuating cylinder member; an actuating piston carried by said actuating piston rod member and defining two actuating chambers within said actuating cavity; actuating fluid connection means for introducing actuating fluid to and removing actuating fluid from said actuating chambers; and damping means for damping axial movement of said actuating piston rod member relative to said actuating cylinder member, said damping means comprising:

(1) said actuating piston rod member comprising a cylindrical member having an axis and two ends and defining a damping cavity therewithin;

(2) a damping piston unit axially movable within said damping cavity in sealing engagement with the interior surface of said actuating piston rod member and defining two damping chambers within said damping cavity;

(3) a damping piston rod member connected to said damping piston unit, said damping piston rod member extending in sealing relation through at least one end of said actuating piston rod member and being connected to said actuating cylinder member;

(4) a self-contained damping fluid sealed within said damping cavity;

(5) flow passage means connecting said two damping chambers and extending through said damping piston unit;

(6) damping valve means associated with said flow passage means for varying the flow cross-section of said flow passage means;

(7) valve operating means associated with said damping valve means for controlling said damping valve means from outside said damping cavity, said valve operating means comprising rod means passing through an axial bore in said damping piston rod member, said rod means adjacent its end remote from said damping valve means being operatively connected to adjusting means provided at said at least one end of said actuating piston rod member;

the improvement comprising:

(a) the flow cross-section defined by said damping valve means being variable by axial movement of said rod means;

(b) said rod means being provided with an engagement face at said remote end thereof; and (c) biasing means being provided for urging said engagement face towards engagement with a continuously adjustable counterengagement face of said adjusting means, said counterengagement face being defined by a counterengagement member movable with respect to said damping piston rod member by a fluidic drive means, the range of movement of said counterengagement member being defined by at least one adjustable abutment member.

2. The fluid-operated actuating device of claim 1, wherein said counterengagement face is defined by a cam face of said counterengagement member, said counterengagement member being adjustable along a direction substantially transverse to the axis of said actuating piston rod member, said cam face being inclined with respect to said transverse direction.

3. The fluid-operated actuating device of claim 1, wherein said counterengagement member is subject to the action of at least one resilient means and is movable by said fluidic drive means against the action of said resilient means.

4. The fluid-operated actuating device of claim 3, wherein said counterengagement member is biased by said resilient means towards a first position and is movable into a second position and a third position by said fluidic drive means, at least two of said first, second and third positions being defined by respective adjustable abutment members.

5. The fluid-operated actuating device of claim 4, wherein the improvement further comprises first and second drive piston members provided in a common cylinder having a first end adjacent said first drive piston member and a second end adjacent said second drive piston member;

a first drive fluid port being provided in said drive cylinder adjacent a first end of said drive cylinder for admitting fluid to act on a first end of said first drive piston member;

a second drive fluid port being provided in said drive cylinder between said first and said second drive piston members for admitting drive fluid acting on the second end of said first drive piston member and on a first end of said second drive piston member adjacent said first drive piston member;

resilient means being provided for biasing said second drive piston member towards said first drive piston member;

a first adjustable abutment member being provided for defining the maximum spacing of said first drive piston member from said first end of said cylinder;

a second adjustable abutment member being provided for defining the minimum spacing of said second drive piston member from said second end of said cylinder; and piston abutment means being provided on said first drive piston member and said second drive piston member adjacent their second and first ends, respectively, for coaction with said first and second adjustable abutment members to define said maximum and minimum spacings, respectively.

6. The fluid-operated actuating device of claim 5, wherein said counterengagement face is provided on said second drive piston member.

7. The fluid-operated actuating device of claim 6, wherein a recess is defined within said first drive piston member, and said first adjustable abutment member enters through an aperture of said first drive piston member into said recess, cooperating shoulder faces being provided on a portion of said first adjustable abutment member housed within said recess and on a portion of said first drive piston member surrounding said aperture.

8. The fluid-operated actuating device of claim 1, wherein said damping piston rod member extends through only one end of said actuating piston rod member, and wherein compressible-volume compensating means are associated with said damping cavity for compensating for the varying volume of said damping piston rod member within said damping cavity during axial movement of said damping piston rod member relative to said actuating piston rod member.

9. The fluid-operated actuating device of claim 8 wherein said damping cavity contains a pressurized gas which comprises said compressible-volume compensating means.

10. The fluid-operated actuating device of claim 8, wherein said damping chambers are filled with a liquid, and said compressible-volume compensating means comprises movable separating means in sealing engagement with the interior surface of said actuating piston rod member for defining an end wall of at least one of said damping chambers, and further comprising resilient means located on that side of said separating means which is remote from said liquid tending to urge said separating means towards said liquid.

11. The fluid-operated actuating device of claim 10, wherein said resilient means comprises mechanical spring means.

12. The fluid-operated actuating device of claim 8, wherein said biasing means are defined by a superatmospheric pressure of said damping fluid within said damping cavity.

13. The fluid-operated actuating device of claim 1, wherein said adjusting means are provided in an end portion defining the end wall at the other end of said actuating cylinder member, said damping piston rod member being axially fastened to said end portion.

14. The fluid-operated actuating device of claim 1, wherein said damping valve means is biased towards a position of maximum flow cross-section by said biasing means.

15. The fluid-operated actuating device of claim 1, wherein said at least one adjustable abutment member is defined by an adjustable abutment screw.

16. The fluid-operated actuating device of claim 1, wherein said counterengagement member comprises a drive piston member (455) of a cylinder-piston drive unit, said drive unit being provided with drive fluid connection means.

17. The fluid-operated actuating device of claim 1, wherein said damping valve means are biased towards a position of minimum flow cross-section by said biasing means.

18. A fluid-operated actuating device of claim 17, wherein said damping valve means are biased towards a closed position by said biasing means.

19. The fluid-operated actuating device of claim 1, wherein said counterengagement face is defined by an axially directed terminal face of a counterengagement member which is adjustable with respect to said damping piston rod member in a direction parallel to said axis of said actuating piston rod member.

20. The fluid-actuating device of claim 1 wherein the improvement further comprises:

(a) compressible-volume compensating means being associated with said damping cavity for compensating for the varying volume of said damping piston rod member within said damping cavity during axial movement of said damping piston rod member relative to said actuating piston rod member, said damping piston rod member extending through only one end of said actuating piston rod member, said compressible volume compensating means comprising (i) movable separating means in sealing engagement with the interior surface of said actuating piston rod member for defining an end wall of at least one of said damping chambers, said damping chambers being filled with a liquid, and (ii) resilient means located on that side of said separating means which is remote from said liquid and tending to urge said separating means toward said liquid; and (b) a dividing wall within said damping cavity axially between said movable separating means and said damping piston unit, said dividing wall being bridged by throttled passage means offering larger flow resistance for said damping fluid through said dividing wall toward said movable separating means, and smaller flow resistance through said dividing wall toward said damping piston unit.

* * * * *

UNITED STATES PATENT AND TRADEMARK OFFICE

CERTIFICATE OF CORRECTION

PATENT NO. : 4,526,088

DATED : July 2, 1985

INVENTOR(S) : Reuschenbach et al.

It is certified that error appears in the above-identified patent and that said Letters Patent is hereby corrected as shown below:

Column 1, lines 34-35, "mean-sfrom" should read --means from--;
line 57, "aother" should read --other--;
Column 2, line 31, after "with" insert --a--;
Column 3, line 1, "with" should read --which--;
Column 12, line 8, delete "(455)"; and
line 15, "A" should read --The--.

Signed and Sealed this

*Twelfth* Day of *November 1985*

[SEAL]

*Attest:*

*Attesting Officer*

DONALD J. QUIGG

*Commissioner of Patents and Trademarks*